US006883494B2

(12) United States Patent
Kurita et al.

(10) Patent No.: US 6,883,494 B2
(45) Date of Patent: Apr. 26, 2005

(54) INTAKE AIR CONTROL APPARATUS FOR AN ENGINE

(75) Inventors: Kazuhisa Kurita, Tokyo (JP); Kenji Nakao, Tokyo (JP); Yoshihiko Onishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/765,358

(22) Filed: Jan. 28, 2004

(65) Prior Publication Data

US 2005/0022785 A1 Feb. 3, 2005

(30) Foreign Application Priority Data

Jul. 29, 2003 (JP) ..... 2003-281992

(51) Int. Cl.[7] ..... F02D 9/08
(52) U.S. Cl. ..... 123/337
(58) Field of Search ..... 123/337, 339, 123/398, 403, 339.14

(56) References Cited

U.S. PATENT DOCUMENTS 5,431,141 A * 7/1995 Kanazawa et al. ..... 123/399
5,644,082 A * 7/1997 Iwata et al. ..... 73/504.03
6,565,067 B1 * 5/2003 Nanba et al. ..... 251/305
6,739,312 B2 * 5/2004 Komeda et al. ..... 123/337

FOREIGN PATENT DOCUMENTS

JP 9-72706 A 3/1997
JP 11-94512 A 4/1999
JP 2001-289610 A 10/2001

* cited by examiner

*Primary Examiner*—Bibhu Mohanty
(74) *Attorney, Agent, or Firm*—Sughrue Mion, PLLC

(57) ABSTRACT

An air control apparatus for an engine can relax the tolerance of positional accuracy in the mounting of a rotational angle detection sensor. The intake air control apparatus includes: a shaft (6); a throttle valve (7) fixedly secured to the shaft (6) for adjusting the degree of opening in an intake passage through a rotational angle thereof; a permanent magnet (12) provided on an end portion of the shaft (6) with its N pole and S pole being positioned in a diametral direction thereof; and a rotational angle detection sensor (14) having a magnetoresistive element disposed in a spaced parallel relation with respect to the permanent magnet (12) for detecting a change in the azimuth of magnetic flux of the permanent magnet (12) thereby to sense a rotational angle of the throttle valve (7).

7 Claims, 7 Drawing Sheets

INTAKE AIR CONTROL APPARATUS FOR AN ENGINE

BACKGROUND OF THE INVENTION

1. Field of the Invention

The present invention relates to an intake air control apparatus for an engine with a rotational angle detection sensor for detecting the rotational angle of a throttle valve that adjusts the degree of opening in an intake passage.

2. Description of the Related Art

In a known intake air control apparatus for an conventional engine, there has been used a flux density detection type sensor provided with a Hall element as a sensor for detecting the rotational angle of a throttle valve fixedly secured to a shaft.

That is, a measurement target having a magnetic circuit constructed by a permanent magnet and a magnetic member is mounted on a sector-shaped final spur gear which is fixedly secured to the shaft. The Hall element is embedded in a cover which is spaced from the final spur gear on a central axis thereof. The Hall element detects the rotational angle of the throttle valve by detecting a change in the density of magnetic flux lines passing through the Hall element through the rotation of the measurement target operatively connected with the final spur gear (for example, see a first patent document: Japanese patent laid-open No. 2001-289610, FIG. 2).

In the above-mentioned intake air control apparatus for an engine, the flux density detection type sensor provided with the Hall element is used so as to detect the rotational angle of the throttle valve. In this case, however, the permanent magnet is arranged on the cylindrical magnetic member, and the sensor detects a change in the flux density based on a change in the direction of the magnetic flux with respect to the measurement target. In this case, if the value of composition of flux density vectors passing through the sensor varies, there takes place a variation in the sensor output. In order to avoid this, it is necessary to stabilize the value of composition of the flux density vectors passing through the sensor in a detection angular range, and hence it is necessary to suppress a variation in the positional accuracy of the measurement target and the sensor (e.g., in the axial direction and in the rotational direction of the shaft) as much as possible. As a result, there is a problem that high mounting accuracy is required.

In particular, in recent years, both the final spur gear and the cover are often made of resin for the purpose of reducing the weight and cost of parts. Therefore, there is another problem that it is also necessary to mount these elements while taking into consideration influences due to dimensional changes of the resin according to atmospheric temperature changes and water absorption.

In addition, there is a further problem that if the sensor output becomes unstable (insufficient linearity with hysteresis), the behavior of the throttle valve is unstabilized with respect to a control signal from an engine control unit (hereinafter referred to as an ECU), so there might be caused inconveniences such as an amount of intake air as required being not able to be obtained.

Particularly, required control accuracy is recently becoming higher and higher in order to improve fuel consumption, driveability, etc., and hence the above-mentioned problems are drawing ever greater attention.

SUMMARY OF THE INVENTION

Accordingly, the present invention is intended to obviate the above-mentioned various problems, and has for its object to provide an intake air control apparatus for an engine which is capable of relaxing or alleviating the tolerance of positional accuracy in mounting a rotational angle detection sensor.

Bearing the above object in mind, the present invention resides in an intake air control apparatus for an engine including: a shaft; a throttle valve fixedly secured to the shaft for adjusting the degree of opening in an intake passage through a rotational angle thereof; and a permanent magnet provided on an end portion of the shaft with its N pole and S pole being positioned in a diametral direction thereof. The apparatus further includes a rotational angle detection sensor having a magnetoresistive element disposed in a spaced parallel relation with respect to the permanent magnet for detecting a change in the azimuth of magnetic flux of the permanent magnet thereby to sense a rotational angle of the throttle valve.

In the intake air control apparatus for an engine as described above according to the present invention, the tolerance of positional accuracy in the mounting of the rotational angle detection sensor can be relaxed or eased, and at the same time an increased variation in the machining accuracy of the rotational angle detection sensor or the like can be allowed, thus making it possible to contribute to cost reduction.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described below in detail while referring to the accompanying drawings.

Embodiment 1.

Hereinafter, reference will be first made to an intake air control apparatus for an engine (hereinafter referred to as an intake air control apparatus) according to a first embodiment of the present invention.

Figure 1:
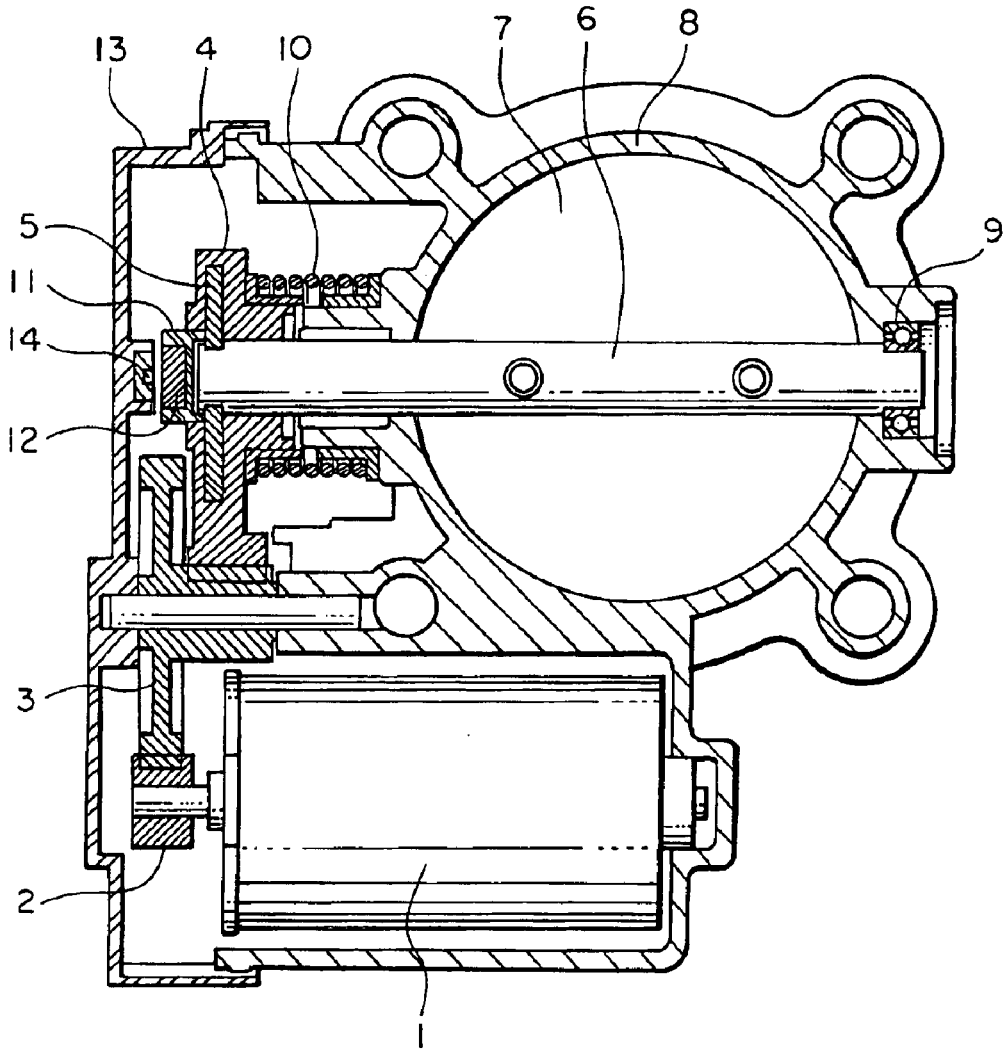
FIG. 1 is a cross sectional side view of an intake air control apparatus for an engine according to a first embodiment of the present invention.
Figure 2:
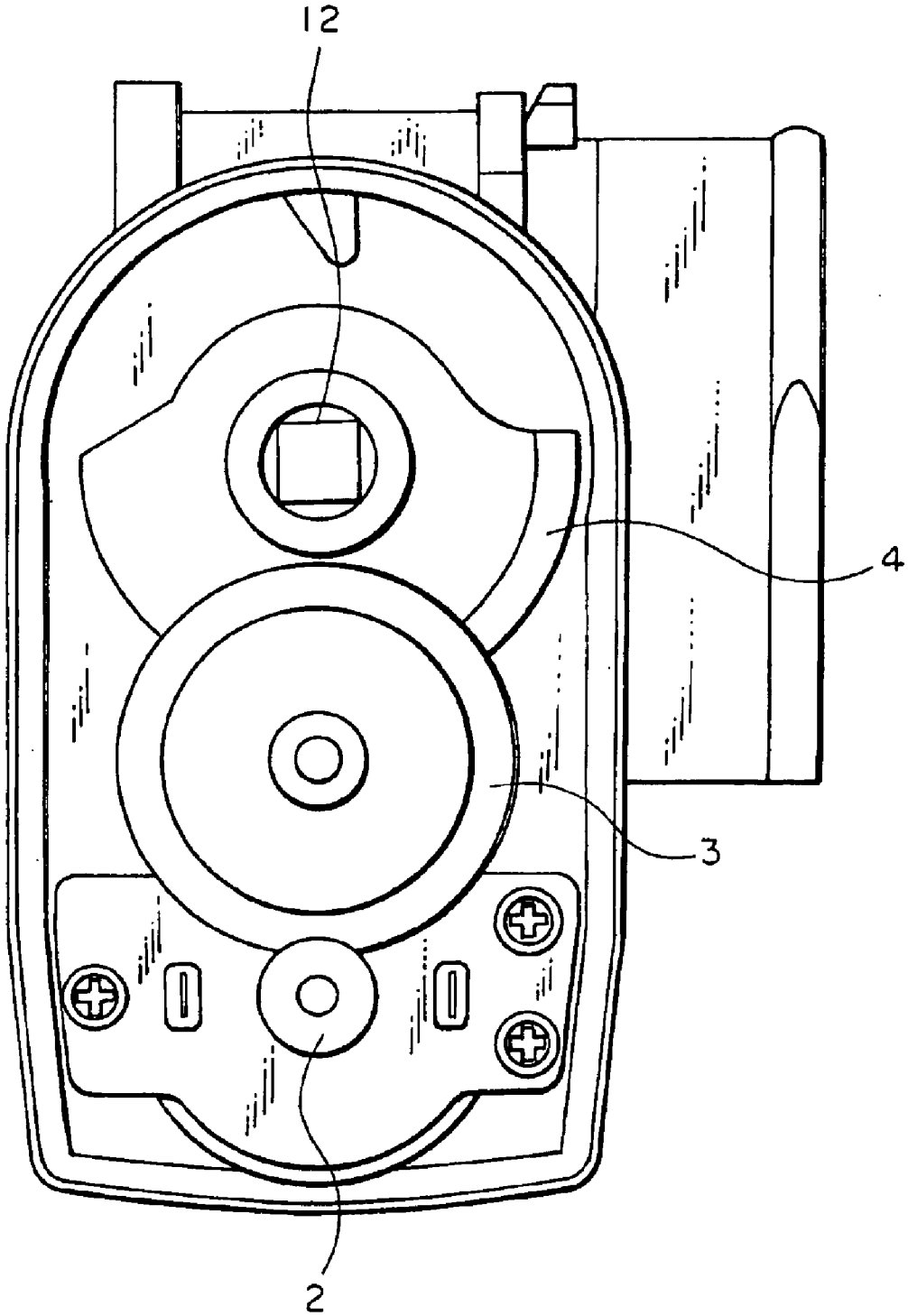
FIG. 2 is a left side view of the intake air control apparatus when a cover of FIG. 1 is removed.

FIG. 1 is a cross sectional side view of this intake air control apparatus, and FIG. 2 is a left side view of the intake air control apparatus with a cover of FIG. 1 being removed.

This intake air control apparatus includes a drive motor 1 adapted to be driven by a direct current, a motor spur gear 2 fixedly mounted on a rotating shaft of the drive motor 1, an intermediate gear 3 made of resin and being arranged in meshing engagement with the motor spur gear 2, a final spur gear 4 of a sector-shaped configuration made of resin and being arranged in meshing engagement with the intermediate gear 3, a disk-shaped plate 5 made of steel and being embedded in the final spur gear 4, a shaft 6 having the final spur gear 4 fixedly mounted thereon at one end thereof and being rotatably supported at its other end by a body 8 through a bearing 9, a throttle valve 7 attached by screws to the shaft 6 for adjusting the flow rate of intake air, and a coiled return spring 10 arranged on the outer periphery of the shaft 6 for returning the throttle valve 7 to an initial position thereof when the engine is at idle rotational speed. The plate 5 is fixedly secured by caulking to the shaft 6, and the final spur gear 4 is integrally coupled with the plate 5 by insert molding.

Also, the intake air control apparatus further includes a receiving portion 11 fixedly attached to an end face of the shaft 6 at a side near the final spur gear 4, a permanent magnet 12 fitted into the receiving portion 11, and a rotational angle detection sensor 14 (hereinafter abbreviated simply as a sensor) using a magnetoresistive element of the magnetic flux azimuth detection type which is spaced at an equal distance from the permanent magnet 12 and embedded in the cover 13.

The permanent magnet 12 is arranged in such a manner as to have its polarity of an N pole and an S pole oriented in a radial direction of the shaft 6. The permanent magnet 12 is of a hexahedral shape, and its flux density with respect to the sensor 14 is adjusted by the distance between the permanent magnet 12 and the sensor 14.

Figure 3:
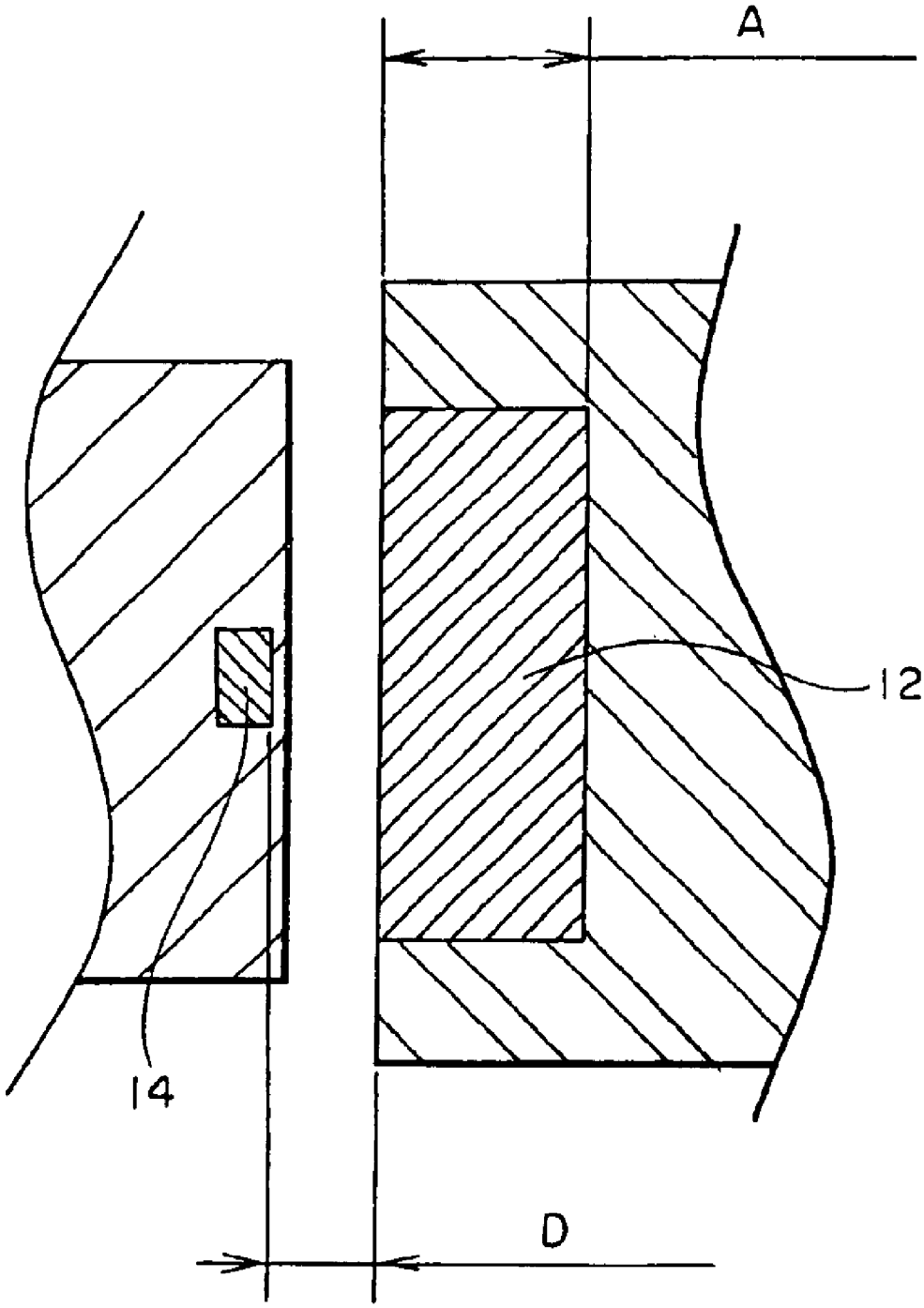
FIG. 3 is a cross sectional view of essential portions of the intake air control apparatus of FIG. 1.
Figure 4:
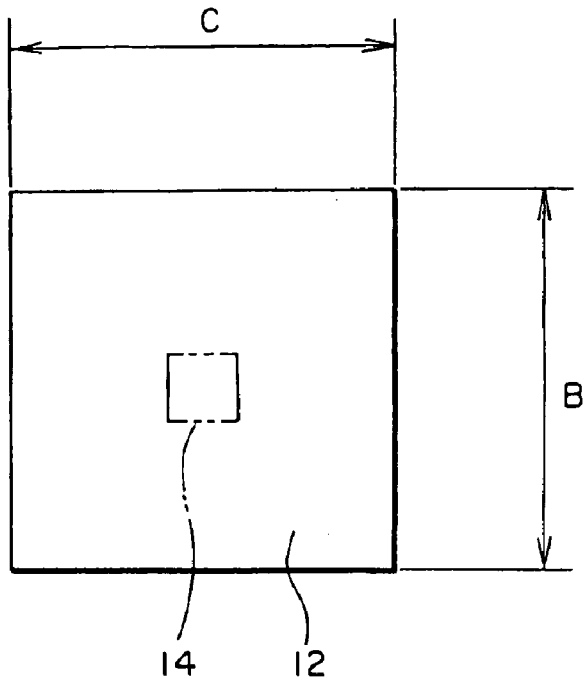
FIG. 4 is a view showing a positional relation between a permanent magnet and a rotational angle detection sensor of FIG. 1.

As shown in FIG. 3 and FIG. 4, the dimensions of the permanent magnet 12 in this embodiment are as follows: the length A in the axial direction of the shaft 6 is 3–6 mm; the length B in the N-pole to S-pole direction (in the vertical direction) is 5–10 mm; the horizontal length C is 5–10 mm; the length D of the space or distance between the sensor 14 and the permanent magnet 12 is 2–5 mm.

Figure 5:
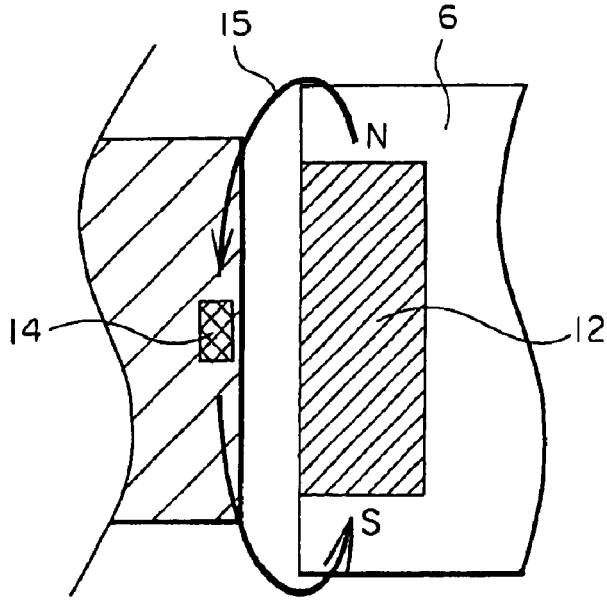
FIG. 5 is a view showing the flow of magnetic flux of the permanent magnet of FIG. 1 when viewed in a radial direction of a shaft.
Figure 6:
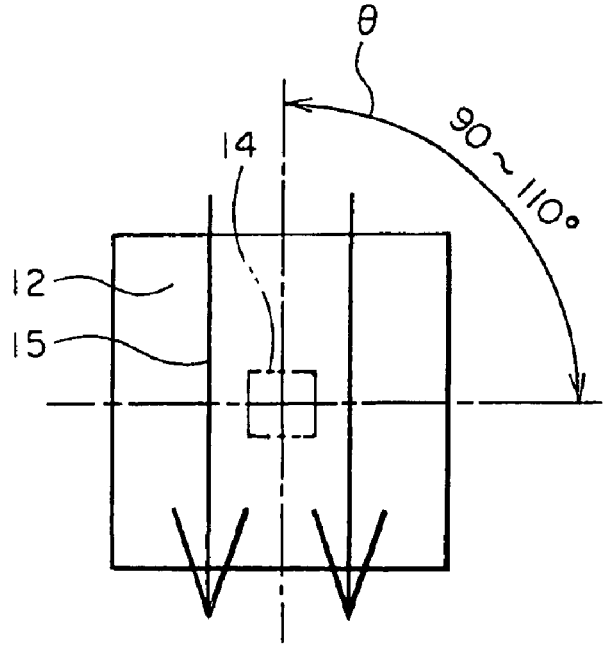
FIG. 6 is a view showing the flow of magnetic flux of the permanent magnet of FIG. 1 when viewed in an axial direction of the shaft.

As shown in FIG. 5, the sensor 14 of the magnetic flux azimuth detection type detects a magnetic flux density or magnetic field strength by the flow of magnetic flux 15 from the permanent magnet 12. In addition, the sensor 14 generates an output signal which varies within a working range θ of the magnetic flux in accordance with the azimuth or direction of the magnetic flux, as shown in FIG. 6. More specifically, the working range θ of the magnetic flux is from 0°, at which the throttle valve 7 is fully dosed, to 90°–1100 at which the throttle valve 7 is fully opened, and the sensor 14 has a linear response within this range. Moreover, the permanent magnet 12 needs a lower limit of a magnetic field so that the magnetoresistive element in the form of a detection part of the sensor 14 can provide a stable output.

NiFe is used as a magnetic material for a magnetoresistive element, and NiFeCo is used as a magnetic material for a giant magnetoresistive element. In comparison with a conventional Hall element, the sensor 14 can generate an output with a magnetic field of a magnitude of about 1/10–1/100 times as weak as that of the conventional Hall element. Accordingly, though in the prior art a permanent magnet of a high coercivity such as a rare earth permanent magnet (Sm Co magnet or neodymium magnet), which is costly, is used as a magnet, a low-cost ferrite magnet can be used in this embodiment for the above purpose.

In the intake air control apparatus as constructed above, when the driver depresses an accelerator pedal, a signal representative of the opening (i.e., the amount of depression) of the accelerator pedal is input from an accelerator opening sensor (not shown) to the ECU. The ECU energizes the drive motor 1 so that the output or rotating shaft of the drive motor 1 is driven to rotate so as to move the throttle valve 7 to a prescribed degree of opening. That is, in accordance with the rotation of the output shaft of the drive motor 1, the intermediate gear 3 and the final spur gear 4 are rotated whereby the shaft 6 integral with the final spur gear 4 is driven to rotated through a prescribed rotational angle. As a result, the throttle valve 7 is rotated to and held at the prescribed rotational angle in an intake passage formed in the body 8.

On the other hand, the sensor 14 detects the azimuth of magnetic flux lines emerging from the permanent magnet 12 that is rotating integrally with the shaft 6, and sends an opening signal representative of the degree of opening of the throttle valve 7 from the sensor 14 to the ECU. Based on this opening signal, the ECU determines how much fuel to inject into the cylinders of the engine.

In the intake air control apparatus as constructed above, the positional relation between the permanent magnet 12 and the sensor 14 is such that the permanent magnet 12 is arranged on the axis of the shaft 6, and the sensor 14 of the magnetic flux azimuth detection type formed integrally with the cover 13 by insert molding is arranged on the axis of the shaft 6 in a spaced parallel relation with respect to the permanent magnet 12. With such an arrangement, assembly accuracy of the permanent magnet 12 and the sensor 14 is relaxed or eased, thus reducing the manufacturing cost, as compared with the prior art requiring that a sensor is arranged on the central axis of a cylindrical-shaped target to be measured.

As a result, it is possible to relax or ease accuracy in assembling the cover 13 into the body 8 as well as accuracy in assembling the final spur gear 4 into the shaft 6, and hence even resins, which are liable to be affected by dimensional changes due to atmospheric temperature and water absorption, can be used as materials for the cover 13 and the final spur gear 4.

Embodiment 2.

Figure 7:
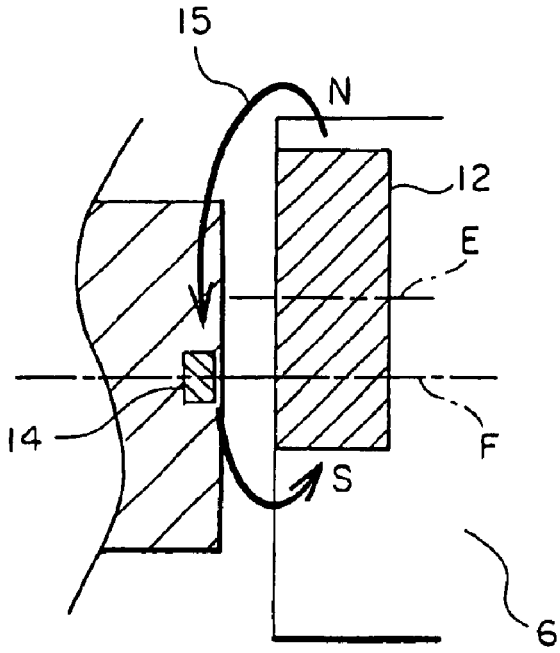
FIG. 7 is a view showing the flow of magnetic flux of a permanent magnet in an intake air control apparatus for an engine according to a second embodiment of the present invention when viewed in a radial direction of a shaft.
Figure 8:
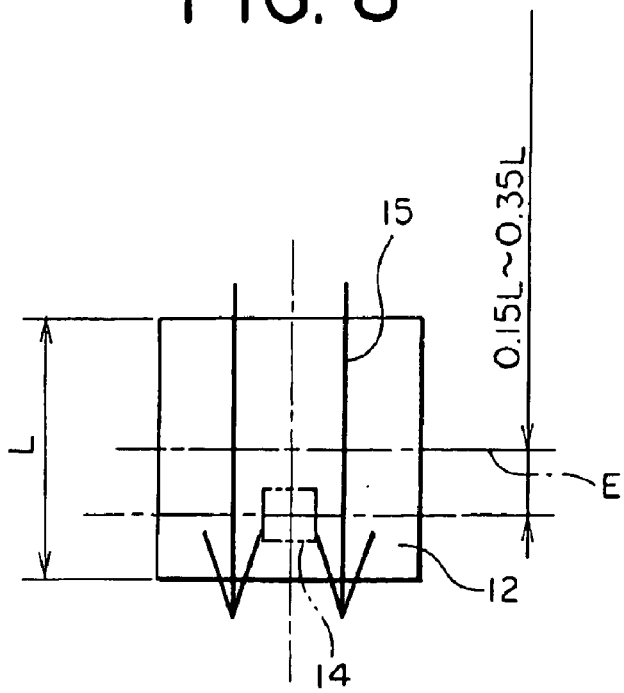
FIG. 8 is a view showing the flow of magnetic flux of the permanent magnet of FIG. 7 when viewed in an axial direction of the shaft.

FIG. 7 and FIG. 8 are views to explain an intake air control apparatus for an engine in accordance with a second embodiment of the present invention. In this embodiment, a permanent magnet 12 is arranged in such a manner that the central axis E thereof is offset with respect to a sensor 14 arranged on the central axis F of a shaft 6. More specifically, assuming that the vertical length of the permanent magnet 12 is L, the sensor 14 is disposed by an offset of 0.15 L–0.35 L from a central line E of the permanent magnet 12 in the vertical direction.

Here, note that the permanent magnet 12 may be arranged on the central axis F of the shaft 6 with the sensor 14 being spaced from this central axis F. In addition, both of the permanent magnet 12 and the sensor 14 may be arranged apart from the central axis F of the shaft 6.

Figure 9:
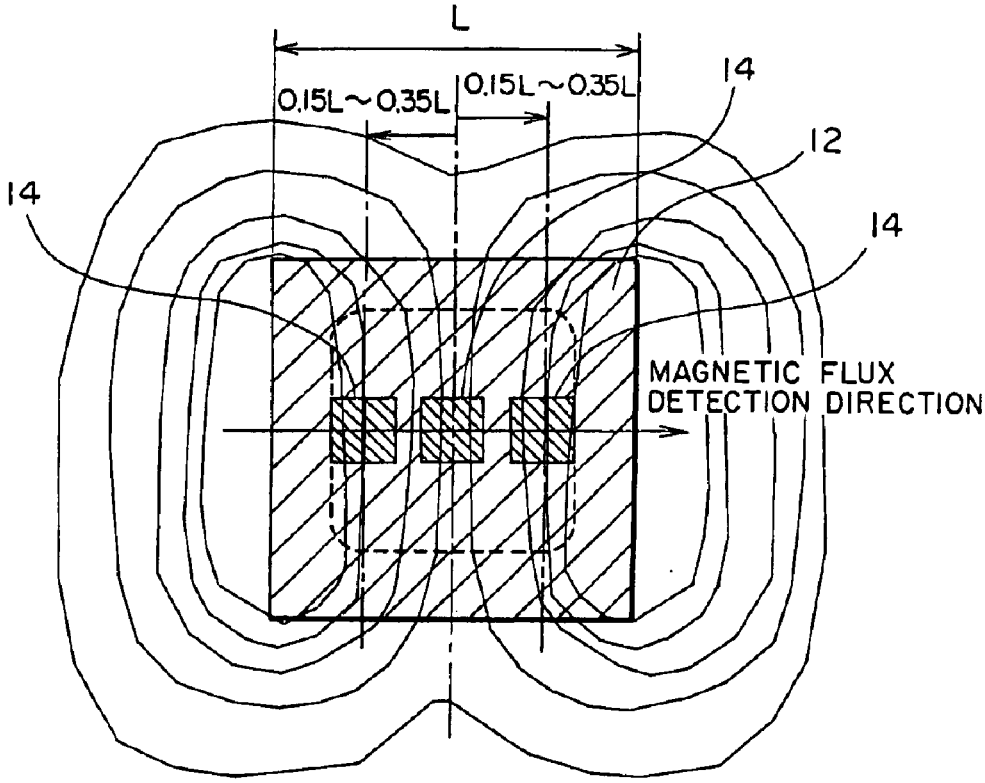
FIG. 9 is a view showing the magnetic field strength distribution of the permanent magnet of FIG. 7.
Figure 10:
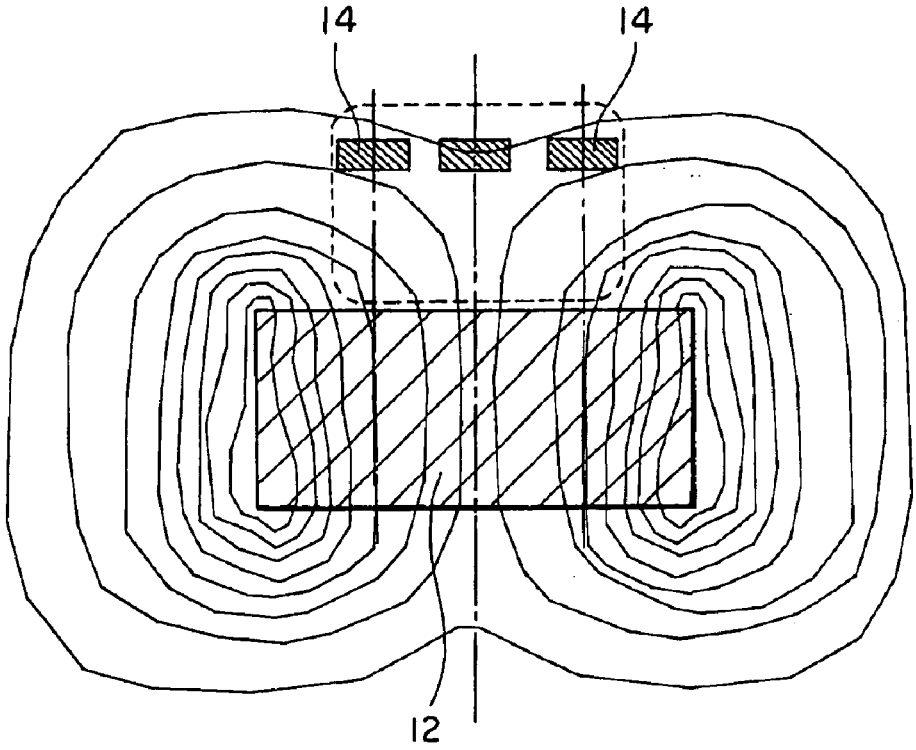
FIG. 10 is a view showing the magnetic field strength distribution of the permanent magnet of FIG. 7 when viewed from one side thereof.

FIG. 9 is a view showing the magnetic field strength distribution of the permanent magnet 12 in the neighborhood of the sensor 14, wherein a broken line indicates a range in which the sensor 14 can be offset from the central line of the permanent magnet 12. FIG. 10 is a view showing the magnetic field strength distribution of the permanent magnet 12 when the permanent magnet 12 of FIG. 9 is viewed from the bottom, wherein a broken line indicates a measurable range in which the sensor 14 arranged apart from the permanent magnet 12 can measure or detect a magnetic field generated by the magnet 12.

The magnetic flux lines of the permanent magnet 12 flow substantially in parallel in the center of a surface of the permanent magnet 12 at its side near the sensor 14, but this center is a neutral position from the N pole and the S pole of the permanent magnet 12, so it is a range where the magnetic field strength is weak. In contrast to this, when the sensor 14 is arranged with an offset of 0.15 L–0.35 L (regardless of polarity) from the central line of the permanent magnet 12, the direction of the magnetic flux lines on a surface of the permanent magnet 12 at its side near the sensor 14 has a slight slope at that position of the sensor 14. However, the directions of flows of the magnetic flux lines 15 passing through the sensor 14 are substantially parallel to each other, as shown in FIG. 8, and the magnetic field generated by the permanent magnet 12 becomes higher at the offset position of the sensor 14 than in the center of the permanent magnet 12.

Thus, in the intake air control apparatus according to this embodiment, the sensor 14 is offset to the N pole side or the S pole side of the permanent magnet 12, and hence the magnetic field detected by the sensor 14 becomes higher as compared with the case where the sensor 14 is arranged in the center of the permanent magnet 12. As a result, the output of the sensor 14 is stabilized against variation in the coercive force of the permanent magnet 12 as well as the magnetic flux coming in from the outside.

Embodiment 3.

Figure 11:
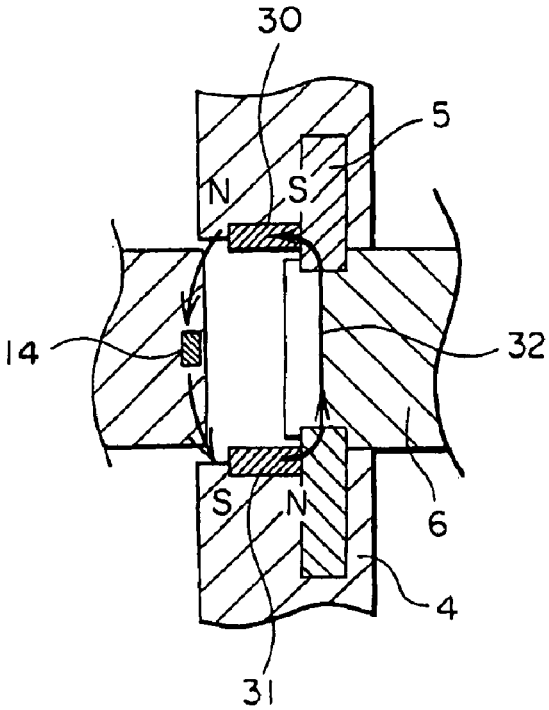
FIG. 11 is a view showing the flow of magnetic flux of a permanent magnet in an intake air control apparatus for an engine according to a third embodiment of the present invention when viewed in a radial direction of a shaft.

FIG. 11 is a view to explain an intake air control apparatus for an engine according to a third embodiment of the present invention. In this embodiment, a first permanent magnet 30 and a second permanent magnet 31 both extending to a cover 13 are mounted on a disk-shaped plate 5.

Also, in this embodiment, a sensor 14 is arranged in a magnetic path 32 formed by the first and second permanent magnets 30, 31 in a spaced parallel relation with respect to an end face of a shaft 6. As a result of such an arrangement, a flux leakage of the permanent magnets 30, 31 is reduced, and the size of the permanent magnet 30 and 31 can be minimized, thus making it possible to reduce the overall size of the intake air control apparatus.

In addition, the plate 5 is a member formed integrally with the final spur gear 4 by insert molding for the purpose of reinforcing the final spur gear 4, and hence there is no need to provide a special member dedicated to supporting the permanent magnets 30, 31.

Moreover, the permanent magnets 30, 31 are fixed to the plate 5 mounted on the shaft 6. Therefore, when the final spur gear 4 together with the permanent magnets 30, 31 and the plate 5 is formed into an integral unit by means of insert molding, there is no fear of positional displacement or shift of the permanent magnets 30, 31. This leads to a constant positional relation between the permanent magnets 30, 31 and the throttle valve 7 fixed to the shaft 6, and hence the sensor 14 can accurately detect the degree of opening of the throttle valve 7.

While the invention has been described in terms of preferred embodiments, those skilled in the art will recognize that the invention can be practiced with modifications within the spirit and scope of the appended claims.

What is claimed is:

1. An intake air control apparatus for an engine comprising:

a shaft;

a throttle valve fixedly secured to said shaft for adjusting the degree of opening in an intake passage through a rotational angle thereof;

a permanent magnet provided on an end portion of said shaft with its N pole and S pole being positioned in a diametral direction thereof; and a rotational angle detection sensor having a magnetoresistive element disposed in a spaced parallel relation with respect to said permanent magnet for detecting a change in the azimuth of magnetic flux of said permanent magnet thereby to sense a rotational angle of said throttle valve.

2. An intake air control apparatus for an engine comprising:

a shaft;

a throttle valve fixedly secured to said shaft for adjusting the degree of opening in an intake passage through a rotational angle thereof;

a first permanent magnet provided on an outer periphery of one end of said shaft with its N pole and S pole being positioned along an axis of said shaft;

a second permanent magnet provided on the outer periphery of the one end of said shaft in opposition to said first permanent magnet with its N pole and S pole being positioned along the axis of said shaft;

a rotational angle detection sensor having a magnetoresistive element disposed in a magnetic path formed by said first permanent magnet and said second permanent magnet in a spaced relation with respect to said shaft for detecting a change in the azimuth of magnetic flux of said permanent magnet thereby to sense a rotational angle of said throttle valve.

3. The intake air control apparatus for an engine as set forth in claim 2, wherein a gear wheel formed integrally with a plate fixedly secured to said shaft is mounted on an end portion of said shaft for transmitting torque from a drive motor to said shaft, and said first permanent magnet and said second permanent magnet are mounted on said plate.

4. The intake air control apparatus for an engine as set forth in claim 1, wherein said rotational angle detection sensor is disposed offset toward an N pole side or an S pole side.

5. The intake air control apparatus for an engine as set forth in claim 1, wherein a body having said intake passage and accommodating therein said shaft and said throttle valve is closed by a cover, and said rotational angle detection sensor is integrally formed with said cover by insert molding.

6. The air intake control apparatus for an engine as set forth in claim 1, wherein a central axis of the permanent magnet is offset from a central axis of the shaft.

7. The air intake control apparatus for an engine as set forth in claim 1, wherein a central axis of the permanent magnet is offset from a central axis of the sensor.

* * * * *